US008573423B2

(12) United States Patent
McGeough et al.

(10) Patent No.: US 8,573,423 B2
(45) Date of Patent: Nov. 5, 2013

(54) RESEALABLE CLOSURES

(75) Inventors: Peter Michael McGeough, Kells (IE); Henning von Spreckelsen, Guildford (GB)

(73) Assignee: Babco Closures Research Ltd., Woking (GB)

( * ) Notice: Subject to any disclaimer, the term of this patent is extended or adjusted under 35 U.S.C. 154(b) by 9 days.

(21) Appl. No.: 13/092,556

(22) Filed: Apr. 22, 2011

(65) Prior Publication Data

US 2011/0192818 A1 Aug. 11, 2011

Related U.S. Application Data

(62) Division of application No. 11/572,517, filed as application No. PCT/GB2005/050118 on Jul. 27, 2005, now Pat. No. 7,963,409.

(30) Foreign Application Priority Data

Jul. 27, 2004 (GB) ..... 0416719.3

(51) Int. Cl.
*B65D 41/00* (2006.01)

(52) U.S. Cl.
USPC ..... 215/256; 215/232; 215/253; 215/258.2; 215/273; 215/344; 220/270; 222/541.9

(58) Field of Classification Search
USPC ..... 215/232, 253, 256, 258.2, 273, 344; 220/270; 222/541.9
See application file for complete search history.

(56) References Cited

U.S. PATENT DOCUMENTS

| | | | |
|---|---|---|---|
| 3,860,152 | A | 1/1975 | Marti |
| 4,387,819 | A | 6/1983 | Corsette |
| 4,682,702 | A | 7/1987 | Gach |

(Continued)

FOREIGN PATENT DOCUMENTS

| | | | |
|---|---|---|---|
| EP | 1547934 | A1 | 6/2005 |
| GB | 2171680 | A | 9/1986 |

(Continued)

OTHER PUBLICATIONS

Wilson, Ring pull innovation ready from Portola, Packaging Magazine, 7(14):4, Jul. 29, 2004, Miller Freeman PLC, GB.

(Continued)

*Primary Examiner* — Anthony Stashick
*Assistant Examiner* — Elizabeth Volz
(74) *Attorney, Agent, or Firm* — Cooper & Dunham LLP

(57) ABSTRACT

A closure comprising a solid colour spout and a transparent overcap is adapted to be sealed to a container neck by means of a double-sided foil. The overcap has a depending valve, which engages with the spout to hold these components together prior to assembly to the container. The spout has a flange adapted to seat on a rim of the container neck and an annular wall that is received within the container neck. The foil is welded to the flange and is also used to weld the closure to a rim of a container neck of standard threaded design. The overcap can screw to an external thread on the container neck. The primary ex-factory seal is provided by welding the assembled closure to the neck. The secondary seal is provided by the engagement of the overcap valve with the spout. The invention discloses an improved method of assembly.

18 Claims, 2 Drawing Sheets

(56) References Cited

U.S. PATENT DOCUMENTS

| | | | | |
|---|---|---|---|---|
| 4,815,618 | A | 3/1989 | Gach | |
| 5,810,207 | A | 9/1998 | Hayashida | |
| 6,422,411 | B1 * | 7/2002 | Gray | 220/254.2 |
| 2002/0000420 | A1 | 1/2002 | Taha | |
| 2004/0094551 | A1 * | 5/2004 | Mavin et al. | 220/258.2 |
| 2004/0217083 | A1 * | 11/2004 | Mavin et al. | 215/253 |

FOREIGN PATENT DOCUMENTS

| | | | |
|---|---|---|---|
| GB | 2218077 | A | 11/1989 |
| GB | 2255083 | A | 10/1992 |
| GB | 2337740 | A | 12/1999 |
| GB | 2384478 | A | 7/2003 |
| GB | 2399814 | A | 9/2004 |
| GB | 2409855 | A | 7/2005 |
| JP | 2002326644 | A | 11/2002 |
| WO | 02/064432 | A2 | 8/2002 |
| ZA | 2003/09139 | A | 7/2004 |

OTHER PUBLICATIONS

Registrar of Patents, Certificate of Patent Office Department of Trade and Industry regarding ZA 2003/09139 open for public inspection Sep. 26, 2004.

* cited by examiner

RESEALABLE CLOSURES

CROSS REFERENCE TO RELATED APPLICATIONS

This application is a divisional of U.S. patent application Ser. No. 11/572,517, filed on Jan. 23, 2007, which is a national stage application under 35 U.S.C. §371 of International Application No. PCT/GB05/050118, filed on Jul. 27, 2005, which claims priority to and the benefit of United Kingdom Application No. 0416719.3, filed on Jul. 27, 2004, the entire contents of each of which are hereby incorporated by reference herein.

BACKGROUND OF THE INVENTION

The present invention relates to resealable closures and more specifically to closures that comprise a spout and overcap that seal together as a unit that can be welded by the use of an induction heat sealing double-sided foil to a container.

This type of resealable closure was first described by Spreckelsen McGeough Ltd in GB-A-2 337 740. That patent specification disclosed for the first time the idea of sealing a neck and cap assembly (referred to herein as a spout and overcap) to the mouth or neck of a polyolefin bottle, preferably by means of a foil (preferably aluminium) coated on both sides with a plastics material that will weld or adhere to the adjacent component. This type of foil with plastics coatings on each surface is described herein as a double-sided foil. In this structure the welding of the foil to the container mouth creates the primary ex-factory seal. This type of resealable closure is generally referred to herein as the BAP® closure technology and GB-A-2 337 740 describes some exemplary embodiments of this technology.

Such resealable closures are particularly advantageous for use in large-scale dairy bottling, but have also been adapted for use with PET and other gas-tight containers as well as in carton fitments and closures for cans.

EP-A-13 65 957 (Mavin et al) describes a variation of the BAP® closure technology in which a spout and overcap are sealed to a bottle neck by a sealing medium which is received in a space defined between co-operating profiles of the closure and neck of the bottle. Mavin teaches that this space must not communicate with the opening at the neck of the bottle. Mavin suggests that the sealing medium might be an annular double-sided foil in the same manner as the BAP® closure technology.

There is also considerable investment in the packaging industry in polyolefin bottles with threaded necks. These existing bottles are usually provided with a primary seal by means of a relatively thick, pealable conduction or induction foil that seals over the mouth of the bottle neck. This is a one-sided foil. A secondary seal is attempted by means of a screw-threaded injection moulded overcap that engages with a threaded neck of the bottle. This secondary seal is notoriously leaky and leaves consumers much dissatisfied. The presence of the foil also means that the initial removal of the overcap sometimes requires considerable torque due to inadvertent undesirable adhesion between foil and overcap.

There are circumstances where a bottling plant that does not have an exclusive supplier of bottles must use an existing neck profile and cannot take advantage of the possibility of the additional bottle light weighting that is available through the BAP® closure technology. While the BAP® closure can be used with such a mouth structure, the cap and spout would need to be reduced in size in order to fit within the existing closure envelope and this necessity gives rise to certain technical problems as discussed below that would not otherwise exist.

Mavin has also appreciated this need to maintain the cap silhouette the same as an existing industry standard and describes a solution in GB-A-2 399 814, which has a priority date of 26 Mar. 2003 prior to the priority date of this application but which was not published until 29 Sep. 2004 after the priority date of this application.

Technical Problems

Firstly there is the technical problem of how to locate the closure on the container during assembly. The positioning of the foil must be such that the welding is effective around the whole of the mouth in order to create a good primary ex-factory seal. The overcap and spout must also be located relative to one another and must not come apart during transit.

Secondly, there are technical problems in fitting an annular foil to a base of the spout. This is a serious difficulty with the spout profiles described by Mavin.

Thirdly the closure must still provide a primary ex-factory seal and a secondary reseal as well as tamper evidence. In the BAP® closure technology as in standard closures that use a peelable foil beneath the overcap, that foil over the mouth of the container provides tamper-evidence. However the foil must be removed. The BAP® closure technology uses a pull-ring attached to a removable central part of the spout to tear the foil. Although this is relatively easy to open, tamper evident closures as used in carton fitments are even easier for consumers to open. These consist of an arrangement of a pull ring attached to a plastics membrane that closes an opening within a spout and is joined to the spout by means of a reduced thickness frangible region. Mavin proposes using such an arrangement for tamper evidence.

With all prior art closures that use a foil or pull ring for tamper evidence it is not possible for the consumer to see that the product has not been opened without removing the overcap. The consumer also has no practical way of being reassured about the quality of the secondary seal.

Mavin concentrates on the use of a thread to provide the secondary re-seal between overcap and spout and therefore the closest prior art is the BAP® closure technology which discloses a closure comprising a spout and an overcap adapted to be sealed to a container neck by means of a double-sided foil, wherein the overcap has a depending valve which sealingly engages with the spout to hold these components together prior to assembly to the container, the spout having a flange covered by the foil and adapted to seat on a rim of the container neck.

The second Mavin application teaches the use of a spout (described by Mavin as an insert) that is received almost entirely within the container neck and supported by means of an annular flange sealed to the rim of the container neck.

This Mavin proposal for use with a ram-down neck finish as illustrated in their FIG. 5 proposes an undercut in the inner wall of the bottle neck to engage with a groove illustrated in the outer surface of the insert. Such an undercut could not be created in a uniform manner so as to give a consistent step at the same vertical plane around the inside of the bottle bore.

Since the spout is received within the neck it does not require any modification to an existing external neck profile. By the simple but elegant expedient of keeping the spout inside the neck it allows the overcap to pass over the spout freely to seat outside the neck. However, this approach taught by Mavin causes significant manufacturing problems as well as usage problems by the customer. It is very difficult to manufacture an annular foil welded onto a spout of such a design as the spouts have no external vertical side walls in order to properly sort and hold them prior to adding an annular foil. Secondly, as the spout must avoid the threads of the overcap after application to a bottle it is extremely difficult to apply the foil accurately during manufacture. Thirdly, even if successfully manufactured at the high speeds required to ensure competitive manufacture, the Mavin insert would always require centralisation by the bottle neck in order to maintain good uniform contact between foil and bottle. This implies a bottle neck orifice which is perfectly round, undamaged and central, and of a diameter which always gives a mild interference fit with the spout. The lightweight plastic extrusion blow moulded bottle making industry has struggled with these issues for years.

Solution of the Invention

The present invention provides a method of assembling a closure comprising a spout, an overcap and a double sided foil, wherein the overcap has a side wall and a depending valve spaced inwardly of the side wall, and wherein the spout comprises an annular flange surrounding an annular wall; comprising the steps of:

sealingly engaging an outer surface of the valve with an inner surface of the annular wall of the spout to hold the overcap and spout together;

subsequently placing the foil to cover the flange; and sealing the foil to the flange.

The overcap can be removed without risk of interference with the spout. The spout is also located centrally relative to the overcap by means of the depending valve. The problems of foil location effectively disappear as the spout does not rattle around inside the overcap and is held centrally in order to facilitate reception of a flimsy foil annulus. It will be appreciated that in this method the spout does not need to be held centrally relative to the bottle or container neck opening by the structure of the bottle neck orifice itself, as it is held by the overcap.

Preferably the sealing is carried out by means of induction heat sealing taking advantage of the aluminium core of the double sided foil. This requires tool access to only one side of the assembly. Other sealing methods may be employed. For example it may be possible to use RF sealing platform technology or dielectric welding equipment such as the processes offered by Stanelco RF Technologies Ltd.

In a preferred embodiment that is particularly advantageous for use with an existing threaded polyolefin bottle neck, the foil is an annular foil or annulus and the annular wall provides means for locating the annular foil between it and the adjacent depending wall of the overcap. This solves the second technical problem. Preferably the annular wall tapers away from the flange to facilitate placing of an annular foil. A ridge may be formed around the annular wall to aid in stretching the foil as it is placed and prevent the foil being accidentally removed prior to welding when the machinery that places the annulus retracts again.

Accordingly, the present invention also provides a closure comprising a spout and an overcap adapted to be sealed to a container neck by means of a double-sided foil, wherein the overcap has a depending valve which sealingly engages with the spout to hold these components together prior to assembly to the container, the spout having a flange covered by the foil and adapted to seat on a rim of the container neck, and an annular wall that is received within the container neck such that the flange is the only part of the spout above the rim, characterised in that a ridge surrounds the annular wall of the spout to retain an annulus of foil.

Alternatively the closure may be characterised in that the overcap is transparent and the flange of the spout is made of a solid colour plastics material.

By using a transparent overcap, it is possible for the consumer to see whether the tamper evidence is in place without removing the overcap. New polypropylene formulations now available allow proper transparency. Although these are more expensive than traditional opaque materials, the construction of the invention allows the use of a compact overcap that will offset the extra expense as the threads are no longer needed to attempt a seal with the neck of the container.

When a transparent overcap is used with a solid colour spout, the user has useful feedback that the closure has been resealed as the coloured flange appears against the transparent plastic. This prevents the overcap being excessively tightened. The closing of the spout flange against the overcap also shows the consumer that the contents are not leaking from the interior of the container into the overcap. This is particularly clear when the contents of the container are white milk which shows up well even in small quantities against the coloured plastic.

In one embodiment a plastics membrane is joined to the annular wall of the spout by means of a reduced thickness frangible region to close the spout and pull means are attached to the membrane to enable its removal. There is thus no need to sever or remove a foil when the closure is opened and this is perceived as being attractive to consumers. The force required to detach the plastics membrane is controllable and relatively modest as it is not necessary to tear a foil welded to it.

A closure of the invention may also be characterised by the use of a foil which covers the flange and is wrapped over the annular wall to close the spout.

The present invention is particularly advantageous for those bottlers that need to use an existing neck profile within an existing height envelope. The overcap of the closure of the invention can engage with the existing external threads of a standard neck finish. Preferably the overcap side wall is taller than conventional in order to accommodate the height of the spout flange when seated on the neck of the container.

BRIEF DESCRIPTION OF THE DRAWINGS

In order that the invention may be well understood two embodiments thereof will now be described, by way of example only, with reference to the accompanying diagrammatic drawings, in which.

Figure 1:
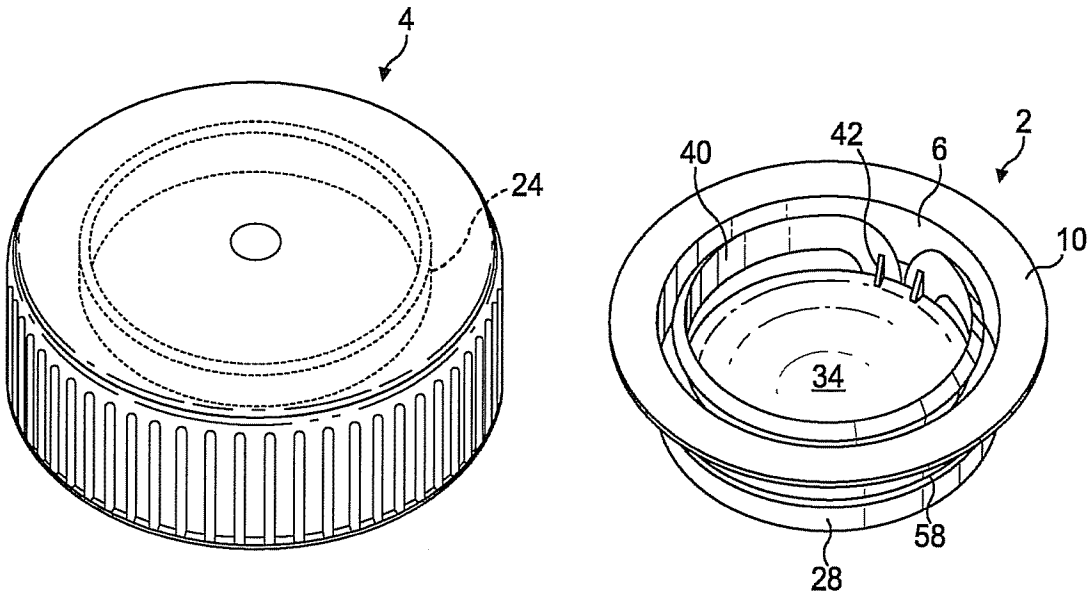
FIG. 1 shows a perspective view of a resealable closure in accordance with a first embodiment of the invention attached to a milk container.

The closure 2 is an assembly of two components, the overcap 4 and the spout 6. An annular ring of double sided foil 8 is sealed to a flange 10 of the spout 6 when the closure 2 is supplied from the factory.

The overcap 4 and spout 6 are preferably both injection moulded components. The two components must be capable of fitting together in sealing engagement in order to hold them together prior to assembly and to provide the secondary reseal. This requires that they be manufactured to close tolerances.

The overcap 4 has a cover plate 20, a depending outer wall 22 and an internal annular depending valve 24. An outer surface of the wall 22 may be knurled in order to facilitate gripping of the overcap. An inner surface of the depending wall 22 has a thread 26.

This type of overcap is very similar to standard existing plastic milk bottle tops for use with peelable foils, except for the presence of an annular valve 24 depending from an inner surface of the cover plate 20. Such a valve cannot be provided on standard overcaps as it would interfere with the peelable foil.

The outer wall 22 of the overcap 4 could be deliberately taller than that of a conventional closure it replaces in order to accommodate the height of the spout flange 10 resting on the top of the container or bottle and to avoid leaving an unattractive gap between a lower edge of the wall and an adjacent surface of the container.

The spout 6 comprises the annular flange 10 surrounding a tapered annular wall 28. An inner surface 30 of the wall 28 sealingly engages with an outer surface 32 of the valve 24. This sealing engagement of the two components allows them to be held together prior to assembly with a container as well as the resealing capability of the closure.

Figure 2:
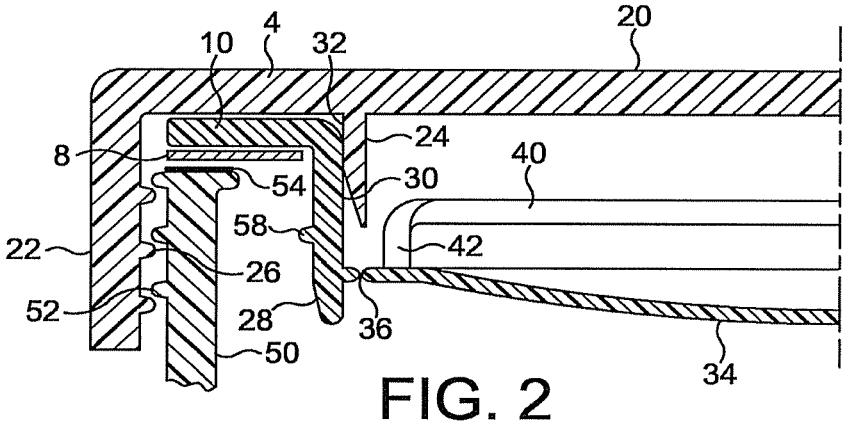
FIG. 2 shows a longitudinal through the assembly of FIG. 1 on the line 2-2 with the component parts shown slightly exploded for clarity.

A membrane 34 is shown in FIG. 2 to close an opening in the spout 6 at the base of the annular wall 28. The membrane 34 is joined to the wall 28 by means of a reduced thickness web or frangible region 36. A pull ring 40 is connected to an edge of the membrane 34 inside the frangible web 36 in order to enable the membrane 34 to be torn out to open the spout 6. The pull ring is attached to the membrane by a leg 42. This type of pull ring mechanism to remove a plastics bottom piece of a spout is a standard feature of closures, particularly those used in carton fitments. It is also suggested in the Mavin application as a means of providing tamper-evident protection.

The closure 2 is adapted to seal to a neck 50 of a container such as a polyethylene or polypropylene lightweight extrusion blow moulded bottle as conventionally used for packaging milk. Such a container has a neck profile provided with a rough screw thread 52 on its external surface. An upper rim 54 of the neck 50 surrounds an opening at the mouth of the container. This rim is typically not perfectly flat due to the type of manufacturing processes used. With a pull-up neck finish the rim 54 is relatively smooth. With a ram-down neck finish a chimney may be formed. However, contrary to the teaching of Mavin, it is still possible to weld a double sided foil to a rim with such a chimney without undue difficulty.

A ridge 58 surrounds the outer surface of the annular wall 28 as shown in FIGS. 1 and 2. The purpose of this ridge is to stetch the foil as it is pushed down over the wall 28 and to prevent the foil being sucked back off the wall 28 when a tool or punch used during the placement step is withdrawn.

Assembly

The closure 2 is assembled by snapping the spout 6 on to the valve 24 of the overcap 4. This results in the formation of an annular slot between the annular wall 28 of the spout and the depending side wall 22 of the overcap. The spout wall 28 is preferably tapered outwardly from the base of the spout where it is closed by the membrane 34 of the bottom as its junction with the flange 10. This facilitates the alignment of an annular foil 8 into a base of the slot and into engagement with the surface 10. If a hole in the centre of the annular foil 8 is just larger than the inner diameter of the flange 10 the foil will necessarily seat close to the wall 28 of the spout ensuring that it is in the correct position to be welded to the flange 10.

The selection of the diameter of the flange 10 is critical to efficient operation of the spout. The flange 10 must terminate short of the internal thread 26 on the wall 22 so that it does not catch on the thread 26 of the overcap and stop the overcap coming off.

In preferred process the annulus of foil 8 is punched into the required annular form during the placing step. Initially an inner hole is punched by means of a punch tool and then a larger punch punches the annulus from the foil and pushes it over the spout 6 afterwards, but in one motion. This completes the placement of the foil. The diameter of the inner hole is slightly smaller than the diameter of the spout so that the foil material, which is flimsy, is stretched as the foil passes down the tapered annular wall. The presence of the ridge 58 further aids in stretching the inner hole and preventing the foil being sucked back from its place against the flange 10 as the two-part tool is withdrawn.

If the outer wall of the spout were recessed as taught by Mavin, the foil would once more become loose once located against the flange 10. Ideally, the material of the foil should be stretched by the tapered annular wall 28 of the spout and held quite tightly in the base of the slot. This facilitates the sealing step.

Method of Use

The closure 2 consisting of the components' overcap, spout and foil, is pre-assembled in the factory. The annular foil ring 8 is induction heat seal welded to the flange 10. The closure in this form can be supplied to a filling plant. The closures are securely held together and can be sterilised and used with conventional filling equipment as the overcap is, for the purposes of the capping equipment, identical to the traditional overcaps used on these containers.

The closure 2 is registered with the opening of the container by means of the engagement of the overcap with the external thread. The inside of the bottle neck cannot be used for registration purposes because of its inaccurate bore tolerances and use of different bore diameters from different suppliers. However, despite these tolerance variations, the rim 54 will always come into contact with some part of the foil coated flange 10 so that the closure can be induction heat sealed to the rim 54 of the container neck 50. The spout and overcap are registered together by means of the valve 24.

In the structure described the foil 8 is not prevented from coming into contact with the contents of the container. It has been shown that for milk the limited exposure of the contents to an exposed edge of aluminium within the double sided foil 8 is undetectable. Where it is desired to avoid any contact of an exposed aluminium edge, the edge could be embedded into the plastics of the spout by the use of a suitable tool during the assembly of the foil to the spout flange 10 or the second embodiment as illustrated in FIG. 3 employed.

Second Embodiment

Figure 3:
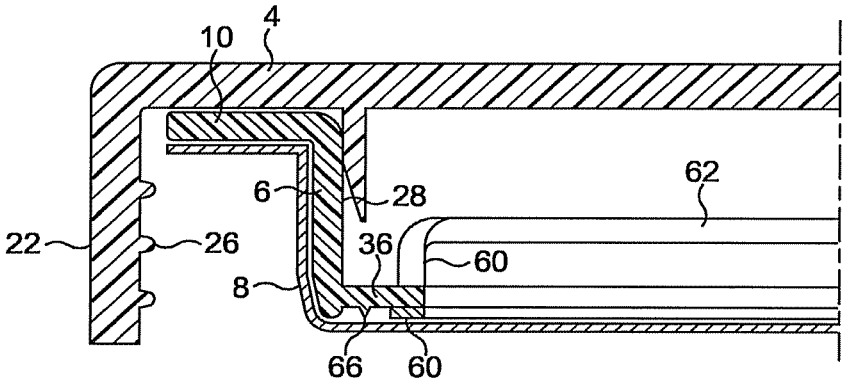
FIG. 3 shows a longitudinal section through a second embodiment of a resealable closure in accordance with the invention.

In the second embodiment of the invention as shown in FIG. 3 the corresponding parts are identified by like reference numerals. In this embodiment, instead of an annular foil, the foil 8 is wrapped around the entire exterior of the spout 6 and covers the flange 10, the external surface of the spout wall 28 and closes an open bottom of the spout 6.

While the original BAP® closure technology of GB-A-2 337 740 used a foil disk, the annular wall in the spout penetrates through location of the flat foil and cause Mavin to focus on the use of a sealing medium that is applied only to the annular flange. While Mavin teaches that the sealing medium may be extruded, sprayed, painted or otherwise applied, the present invention uses a more convenient double-sided foil.

When such a foil 8 is wrapped over the spout, the foil has to be bent around the base of the annular wall and into the internal corner between the wall 28 and flange 10. This causes creasing of the foil. It is possible to weld through creased foil with the appropriate degree of attention to the direction of the induction fields to ensure that the melting of the plastics layers is sufficient to produce an effective weld.

In an alternative approach a foil disk 8 could be applied to a lower surface of a flat ring of plastic that is effectively a precursor spout 6. The spout would then be created by means of a tool applied to the centre of the ring to force part of the ring downwardly to form the annular wall 28. Other mechanisms could be employed to fold the foil wrapped precursor spout. GB-A-2 384 478 shows one approach to creating an internal wall from a flat flange by the use of a downward fitting former after a closure has been applied to a bottle neck.

In a third solution, a very thin foil could be used which was folded or drawn in such a shape/way that does not cause creases in the region where the foil is to be welded to the annular flange 10 and rim 54.

In this embodiment, it is not necessary to provide a complete membrane 34 across a base of the spout as the foil web itself provides tamper evidence. A removable part 60 in the form of an annular ring with a star shaped centre as described in GB-A-2 377 701 can be used to enable the web of foil across the base of the spout to be torn. The removable part 60 has a pull ring 62 attached by means of a leg 64 to the annular ring. Teeth 66 are provided at a frangible region 36 between the removable part 60 and an end of the wall 28 to the spout 6. These teeth 66 serve to facilitate tearing of the foil 8.

It will be appreciated that by using a spout which seats inside the bottle neck the outer profile of the bottle neck and the overcap can be exactly as used in standard fitting without losing any of the advantages otherwise available through the BAP® closure. The closure is also a complete assembly that is safe for use in transit prior to sorting and application.

Tamper Evidence and Colour

Colour is used in milk packaging to indicate fat content. Typically solid colour overcaps are used. The customer therefore has no indication that peelable foil is still in place until the cap is removed. Improved tamper evidence can be obtained with either embodiment of the present invention by making the overcap transparent and the spout of solid colour. When the spout 6 has been opened the flange 10 appears as a solid colour ring against the cover plate 20 of the overcap. When the container is positioned sideways in a 'fridge the level of milk within the circle of the flange 10 provides a useful indication of the remaining contents of the container. The reseal is so good with this type of closure that laying containers on their sides is possible without fear of the leakage problems of prior art overcaps with peelable foils. Any tendency to leak would also be apparent by the appearance of white milk between the engaging faces of the flange 10 and inside of the cover plate 20.

Variation

Although the principal advantage of using a spout that engages inside the container neck as opposed to outside of the container neck is to allow it to be used with an existing screw thread profiled neck, it is also possible to use this type of resealable closure with a snap on overcap or other flip top types of overcap design as will be appreciated by those skilled in the art.

The invention claimed is:

1. A closure comprising:

a spout, an overcap, and an annular double sided foil, the closure being adapted to be sealed to a container neck by means of the annular double sided foil, wherein the overcap has a depending valve which sealingly engages with the spout, and wherein the spout comprises:

a flange covered by the annular double sided foil, the annular double sided foil adapted to seat on a rim of the container neck, and an annular wall adapted to be received within the container neck, the annular wall terminating in a depending tapered edge, the annular wall having a free edge forming one side of an annular slot having the flange as its base and retaining the annular double sided foil in the slot.

2. The closure of claim 1, wherein the flange is the only part of the spout above the rim of the container neck.

3. The closure of claim 1, wherein the overcap is transparent.

4. The closure of claim 1, wherein the flange is a solid color.

5. The closure of claim 1, wherein the spout is a solid color.

6. The closure of claim 1, wherein the overcap comprises a screw thread for engaging with a thread on an external wall of the container neck.

7. The closure of claim 1, wherein overcap snap fits to the container neck.

8. The closure of claim 1, wherein the overcap side wall is configured to accommodate the height of the spout flange when the flange is seated on the container neck.

9. The closure of claim 1, wherein the annular wall comprises an annular ridge for retaining the annular double sided foil.

10. The closure of claim 1, wherein the free edge of the annular wall of the spout engages an inner diameter of the annular double sided foil to hold the annular double sided foil in the annular slot.

11. The closure of claim 1 wherein an inner diameter of the annular double sided foil is slightly smaller than an outer diameter of the free edge of the annular wall of the spout such that the annular double sided foil is stretched around the annular wall of the spout.

12. The closure of claim 1, wherein the free edge of the annular wall of the spout and the annular double sided foil are configured such that the annular double sided foil seats adjacent the annular wall of the spout.

13. The closure of claim 12, wherein an inner diameter of the annular double sided foil is just larger than an outer diameter of the free edge of the annular wall of the spout.

14. The closure of claim 1, wherein the spout comprises a removable membrane that that is joined to the annular wall of the spout by a frangible region.

15. The closure of claim 14, wherein a pull ring is attached to the removable membrane to enable removal of the removable membrane from the spout.

16. The closure of claim 15, wherein the pull ring is attached to the removable membrane by a leg.

17. A closure comprising:

a spout, an overcap and an annular double sided foil, the closure being adapted to be sealed to a container neck by means of the annular double sided foil, wherein the overcap has a depending valve which sealingly engages with the spout, and wherein the spout comprises:

a flange covered by the annular double sided foil, the annular double sided foil adapted to seat on a rim of the container neck, and an annular wall adapted to be received within the container neck, the annular wall terminating in a depending tapered edge, the annular wall having a free edge forming one side of an annular slot and retaining the annular double sided foil, and wherein the tapered edge of the annular wall tapers away from the flange to facilitate placing the annular double sided foil around the annular wall.

18. A closure comprising:

a spout, an overcap, and a double sided foil, the closure being adapted to be sealed to a container neck by means of the double sided foil, and the foil being configured to seal the spout, wherein the overcap has a depending valve which sealingly engages with the spout, and wherein the spout comprises:

a flange covered by the double sided foil, the double sided foil adapted to seat on a rim of the container neck, and an annular wall adapted to be received within the container neck, the annular wall terminating in a depending tapered edge, the double sided foil closing the open bottom of the spout to seal the spout.

* * * * *

UNITED STATES PATENT AND TRADEMARK OFFICE

CERTIFICATE OF CORRECTION

PATENT NO. : 8,573,423 B2
APPLICATION NO. : 13/092556
DATED : November 5, 2013
INVENTOR(S) : Peter Michael McGeough and Henning von Spreckelsen It is certified that error appears in the above-identified patent and that said Letters Patent is hereby corrected as shown below:

On the Title Page:

Item (73) Assignee, "Babco Closures Research Ltd." should be changed to --Bapco Closures Research Ltd.--

Signed and Sealed this
Fifth Day of August, 2014

Michelle K. Lee

Michelle K. Lee
*Deputy Director of the United States Patent and Trademark Office*